US011703005B2

(12) United States Patent
Killingseder et al.

(10) Patent No.: US 11,703,005 B2
(45) Date of Patent: Jul. 18, 2023

(54) CRANKING PROCEDURE FOR A FOUR-STROKE INTERNAL COMBUSTION ENGINE WITH A CRANKSHAFT MOUNTED ELECTRIC TURNING MACHINE

(71) Applicant: BRP-ROTAX GMBH & CO. KG, Gunskirchen (AT)

(72) Inventors: Lukas Killingseder, Eschenau im Hausruckkreis (AT); Martin Freudenthaler, Stadl-Paura (AT); Alexander Burgstaller, Bad Schallerbach (AT); Philipp Hollinger, Unterweitersdorf (AT)

(73) Assignee: BRP-ROTAX GMBH & CO. KG, Gunskirchen (AT)

( * ) Notice: Subject to any disclaimer, the term of this patent is extended or adjusted under 35 U.S.C. 154(b) by 0 days.

(21) Appl. No.: 17/153,189

(22) Filed: Jan. 20, 2021

(65) Prior Publication Data

US 2021/0222639 A1 Jul. 22, 2021

Related U.S. Application Data

(60) Provisional application No. 62/963,435, filed on Jan. 20, 2020.

(51) Int. Cl.
*F02D 41/06* (2006.01)
*F01L 1/04* (2006.01)
(Continued)

(52) U.S. Cl.
CPC ..... *F02D 41/062* (2013.01); *F01L 1/047* (2013.01); *F02D 41/009* (2013.01); *F02D 41/40* (2013.01);
(Continued)

(58) Field of Classification Search
CPC ..... F02D 41/06; F02D 41/062; F02D 41/009; F02D 41/40; F02D 2200/023;
(Continued)

(56) References Cited

U.S. PATENT DOCUMENTS 5,713,320 A 2/1998 Pfaff et al.
6,782,860 B2 8/2004 Makajima et al.
(Continued)

FOREIGN PATENT DOCUMENTS

DE 102016205450 A1 10/2017
EP 1233175 A1 8/2002
(Continued)

OTHER PUBLICATIONS

English translation of DE102016205450A1 retrieved from https://patents.google.com/patent/DE102016205450A1/en?oq=102016205450 on Jul. 16, 2021.
(Continued)

*Primary Examiner* — John Kwon
*Assistant Examiner* — Johnny H Hoang
(74) *Attorney, Agent, or Firm* — BCF LLP

(57) ABSTRACT

An internal combustion engine has one or more combustion chambers defined by one of more cylinders, corresponding pistons, and a cylinder head. A crankshaft is operatively connected to the pistons and to an electric turning machine. To start the engine, the electric turning machine rotates the crankshaft in a first direction toward a reversal point corresponding to a local maximum drag torque of the internal combustion engine, this rotation being made without rotating the crankshaft beyond the reversal point. The electric turning machine then rotates the crankshaft in a second direction opposite from the first direction, a momentum impressed on the crankshaft by compression obtained when rotating in the first direction increasing a speed of the
(Continued)

crankshaft in the second direction. Thereafter, fuel is injected in one of the combustion chambers in which the corresponding piston first reaches a top dead center position and the fuel is ignited.

22 Claims, 10 Drawing Sheets

(51) Int. Cl.

| | |
|---|---|
| ***F01L 1/047*** | (2006.01) |
| ***F02D 41/00*** | (2006.01) |
| ***F02D 41/40*** | (2006.01) |
| ***F02N 11/08*** | (2006.01) |

(52) U.S. Cl.
CPC ..... *F02N 11/0862* (2013.01); *F01L 2820/041* (2013.01); *F02D 2200/023* (2013.01); *F02D 2200/0414* (2013.01); *F02D 2200/70* (2013.01)

(58) Field of Classification Search
CPC ..... F02D 2200/0414; F02D 2200/70; F02N 11/0862; F01L 1/047; F01L 2820/041
See application file for complete search history.

(56) References Cited

U.S. PATENT DOCUMENTS

| | | | | |
|---|---|---|---|---|
| 6,851,404 | B2 | 2/2005 | Kojima | |
| 6,877,470 | B2 | 4/2005 | Mitani et al. | |
| 8,448,621 | B2 | 5/2013 | Osawa et al. | |
| 9,845,782 | B1 * | 12/2017 | Bernier | F02B 75/04 |
| 2004/0060530 | A1 | 4/2004 | Mitani et al. | |
| 2004/0226530 | A1 | 11/2004 | Kojima | |
| 2016/0160772 | A1 * | 6/2016 | Keating | F02M 26/22 701/108 |

FOREIGN PATENT DOCUMENTS

| | | | |
|---|---|---|---|
| EP | 1321667 | A1 | 6/2003 |
| EP | 2998546 | A1 | 3/2016 |
| EP | 3533994 | A1 | 9/2019 |
| FR | 2805571 | A1 | 8/2001 |
| JP | 2000283012 | A | 10/2000 |
| JP | 2003184712 | A | 7/2003 |
| WO | 2009073951 | A1 | 6/2009 |

OTHER PUBLICATIONS

English translation of FR2805571A1 retrieved from https://patents google.com/patent/FR2805571A1/en?oq-fr2805571 on Jul. 16, 2021.
English translation of JP2003184712A retrieved from https://patents. google.com/patent/JP2003184712A/en?oq=JP2003184712 on Jul. 16, 2021.
English translation of JP2000283012A retrieved from https://patents. google.com/patent/JP2000283012A/en?oq=JP2000283012 on Jul. 16, 2021.
European Search Report issued from the EPO dated Jun. 10, 2021 in connection with the corresponding application No. 21152633; Klaus Rottger.
Klingler, "Dynamisches Simulationsmodell zur Abbildung des Schleppverhaltens eines Otto-Viertaktmotors beim Startvorgang", bachelor thesis, FH Technikum, Vienna, 2017.
Lughofer, "Development of a Dynamic Simulation Model for the Starting Process of Combustion Engines", bachelor thesis, University of Applied Sciences Upper Austria, Wels, Sep. 2016.

* cited by examiner

CRANKING PROCEDURE FOR A FOUR-STROKE INTERNAL COMBUSTION ENGINE WITH A CRANKSHAFT MOUNTED ELECTRIC TURNING MACHINE

CROSS-REFERENCE

The present application claims priority from U.S. Provisional Patent Application Ser. No. 62/963,435, filed on Jan. 20, 2020, the disclosure of which is incorporated by reference herein in its entirety.

FIELD OF TECHNOLOGY

The present disclosure describes a starting procedure. This procedure uses the mass moment of inertia and the compression phase of an internal combustion engine for facilitating the starting procedure when an electric turning machine is mounted on the crankshaft.

BACKGROUND

Some vehicles are powered by four-stroke internal combustion engines (ICE) having, for example, a three-cylinder inline configuration. Such vehicles may include, for example and without limitation, motorcycles, off-road vehicles, and the like. FIG. 1 shows the behavior of a four-stroke three-cylinder ICE having an evenly distributed firing sequence, i.e. one combustion every 240° of crankshaft rotation. Various parameters are plotted against the crankshaft angle $\varphi_{CS}$, using the example of the three-cylinder inline ICE. Curve 110*a* shows the resulting drag torque $T_{Drag}$ on the crankshaft. Curve 112*a* shows the piston position of the second cylinder $S_{piston,2}$. Curves 114*a*, 114*b* and 114*c* respectively show the pressures in the three cylinders $p_{Cyl}$. Curves 116*a*, 116*b* and 116*c* respectively the states of the intake valves in the three cylinders $h_{IV}$. Curves 118*a*, 118*b* and 118*c* respectively the states of the exhaust valves in the three cylinders $h_{EV}$. Within two revolutions of the crankshaft, each individual cylinder goes through the four-stroke process exactly once. The individual strokes therefore do not run one after the other, but in parallel and in this case shifted by 240° with respect to the rotation of the crankshaft. For reasons of clarity, it may be noted that the curves 110*a*, 112*a*, 114*a*, 116*a* and 118*a* illustrate the behavior of the middle cylinder on the various graphs of FIG. 1. In particular, the position of the middle piston $S_{piston,2}$ between the top dead center (TDC) and bottom dead center (BDC) is shown on curve 112*a*.

The value of the drag torque $T_{Drag}$ (curve 110*a*) results largely from the opening and closing of the valves for the middle piston $S_{piston,2}$. It is apparent that, when the intake and exhaust valve are closed, the drag torque reaches its maximum due to compression. The minimum drag torque occurs in the area in which both valves overlap briefly, i.e. where the exhaust valve has not yet closed completely, and the inlet valve is already beginning to open. After the combustion in the combustion chamber, due to ignition of the air/fuel mixture, which causes the piston to move from TDC to BDC, the drag torque $T_{Drag}$ also becomes negative and thus accelerates the crankshaft. The energy stored in the compressed gas mass is thus released again to the crankshaft, which accelerates it. Afterwards both valves are closed again and the force to be applied to overcome the drag torque increases again.

SUMMARY

It is an object of the present technology to ameliorate at least some of the inconveniences present in the prior art.

In a first aspect, the present technology provides a method for starting an internal combustion engine, the engine having: one or more cylinders, at least one cylinder head connected to the one or more cylinders, one or more pistons, each piston being disposed in a corresponding one of each of the one or more cylinders, one or more variable volume combustion chambers, each combustion chamber being defined between a corresponding one of the one more cylinders, the corresponding piston and the at least one cylinder head, and a crankshaft operatively connected to each of the one or more pistons, the method comprising: a) selectively rotating the crankshaft, using an electric turning machine operatively connected to the crankshaft, in a first direction toward a reversal point close to a local maximum drag torque of the internal combustion engine without rotating the crankshaft beyond the reversal point; b) following operation a), selectively rotating the crankshaft, using the electric turning machine, in a second direction opposite from the first direction; and c) following operation b), selectively injecting fuel in one of the one or more combustion chambers in which the corresponding piston first reaches a top dead center (TDC) position and selectively igniting the fuel in the one of the one or more combustion chambers.

In some implementations of the present technology, the method further comprises executing both operations a) and b) at least a second time before executing operation c).

In some implementations of the present technology, the method further comprises: evaluating an angular position of the crankshaft; and continuing to execute both operations a) and b) until the angular position of the crankshaft reaches a predetermined limit in the first direction after operation a).

In some implementations of the present technology, the method further comprises: evaluating an angular position of the crankshaft; and continuing to execute both operations a) and b) until a difference between the angular positions of the crankshaft obtained after operation a) and the angular position of the crankshaft obtained after operation b) reaches a predetermined limit.

In some implementations of the present technology, the engine further has: an accessory engine component driven by the crankshaft so that the accessory engine component rotates once for each two rotations of the crankshaft, the method further comprising: d) sensing a current angular position of the accessory engine component; e) determining, based on the current angular position of the accessory engine component, whether the internal combustion engine is stopped in a first rest position or in a second rest position; f) if the internal combustion engine is stopped in the first rest position: executing operations a), b) and c); and g) if the internal combustion engine is stopped in the second rest position: g1) rotating the crankshaft, using the electric turning machine, in the second direction, and g2) following operation g1), injecting fuel in one of the one or more combustion chambers in which the corresponding piston first reaches the TDC position and igniting the fuel in the one of the one or more combustion chambers.

In some implementations of the present technology, the accessory engine component is a camshaft.

In some implementations of the present technology, the method further comprises determining an angular position of the crankshaft at the reversal point based on the current position of the accessory engine component.

In some implementations of the present technology, the method further comprises setting a level of current delivered to the electric turning machine according to a desired speed of the crankshaft rotating in the first direction.

In some implementations of the present technology, the method further comprises determining the reversal point of the internal combustion engine based on a rotational speed of the crankshaft when the crankshaft is rotating in the first direction.

In some implementations of the present technology, the method further comprises: sensing a temperature selected from an ambient temperature, an engine coolant temperature, an engine oil temperature, and an air temperature in an intake of the internal combustion engine; and determining a desired speed of rotation of the crankshaft in the first direction as a function of the sensed temperature.

In some implementations of the present technology, the method further comprises: sensing a temperature selected from an ambient temperature, an engine coolant temperature, an engine oil temperature, and an air temperature in an intake of the internal combustion engine; and determining a level of current delivered to the electric turning machine when rotating the crankshaft in the first direction as a function of the sensed temperature.

In some implementations of the present technology, rotating the crankshaft toward the reversal point comprises stopping the rotation of the crankshaft at a predetermined angle of rotation corresponding to the reversal point.

In some implementations of the present technology, the method further comprises stopping the rotation of the crankshaft in the first direction if the crankshaft does not reach the predetermined angle of rotation ahead of the reversal point within a predetermined time.

In some implementations of the present technology, the method further comprises: starting a timer when initiating the rotation of the crankshaft in the first direction; and after a predetermined minimum compression time has elapsed, stopping the rotation of the crankshaft if a rotational speed of the crankshaft in the first direction does not reduce to a predetermined level a before a predetermined maximum compression time.

In some implementations of the present technology, the second direction is a normal operation direction of the internal combustion engine.

In some implementations of the present technology, the method further comprises: sensing an angular rotor position of the electric turning machine by injecting a high-frequency signal into the electric turning machine and analyzing a response signal from the electric turning machine; and using the sensed angular rotor position of the electric turning machine to determine an angular position of the crankshaft.

In some implementations of the present technology, the method further comprises interrupting one or more of the operations a), b) and c) having not yet been performed in response to detecting one or more conditions selected from a detection that the crankshaft is not rotating, a detection of a failure of the internal combustion engine, a detection of a failure of the electric turning machine, and a detection of a command for aborting the starting of the internal combustion engine.

In some implementations of the present technology, the method further comprises: calculating a derivative of the drag torque of the internal combustion engine as a function of an angular position of the crankshaft rotating in the first direction; and starting to rotate the crankshaft in the second direction when the derivative of the drag torque reaches a threshold value δ, wherein δ is less than zero.

In a second aspect, the present technology provides an engine control unit, comprising: an input/output device adapted for communicating with an internal combustion engine, with an electric turning machine operatively connected to the internal combustion engine, and with an inverter adapted for delivering power to the electric turning machine; and a processor operatively connected to the input/output device, the processor being configured for: a) selectively causing the inverter to deliver power to the electric turning machine for causing a rotation of a crankshaft of the internal combustion engine in a first direction toward a reversal point close to a local maximum drag torque of the internal combustion engine without rotating the crankshaft beyond the reversal point; b) following operation a), selectively causing the inverter to deliver power to the electric turning machine for causing a rotation of the crankshaft in a second direction opposite from the first direction; and c) following operation b), selectively causing an injection system of the internal combustion engine to inject fuel in a combustion chamber of the internal combustion engine in which a corresponding piston first reaches a top dead center (TDC) position and selectively causing an ignition system of the internal combustion engine to ignite the fuel injected in the combustion chamber.

In a third aspect, the present technology provides a powertrain, comprising: an internal combustion engine, the engine having: one or more cylinders, at least one cylinder head connected to the one or more cylinders, one or more pistons, each piston being disposed in a corresponding one of each of the one or more cylinders, one or more variable volume combustion chambers, each combustion chamber being defined between a corresponding one of the one more cylinders, the corresponding piston and the at least one cylinder head, and a crankshaft operatively connected to each of the one or more pistons; a battery; an inverter adapted for converting power delivered by the battery; an electric turning machine operatively connected to the crankshaft and adapted for rotating the crankshaft when receiving power from the inverter; and the engine control unit.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
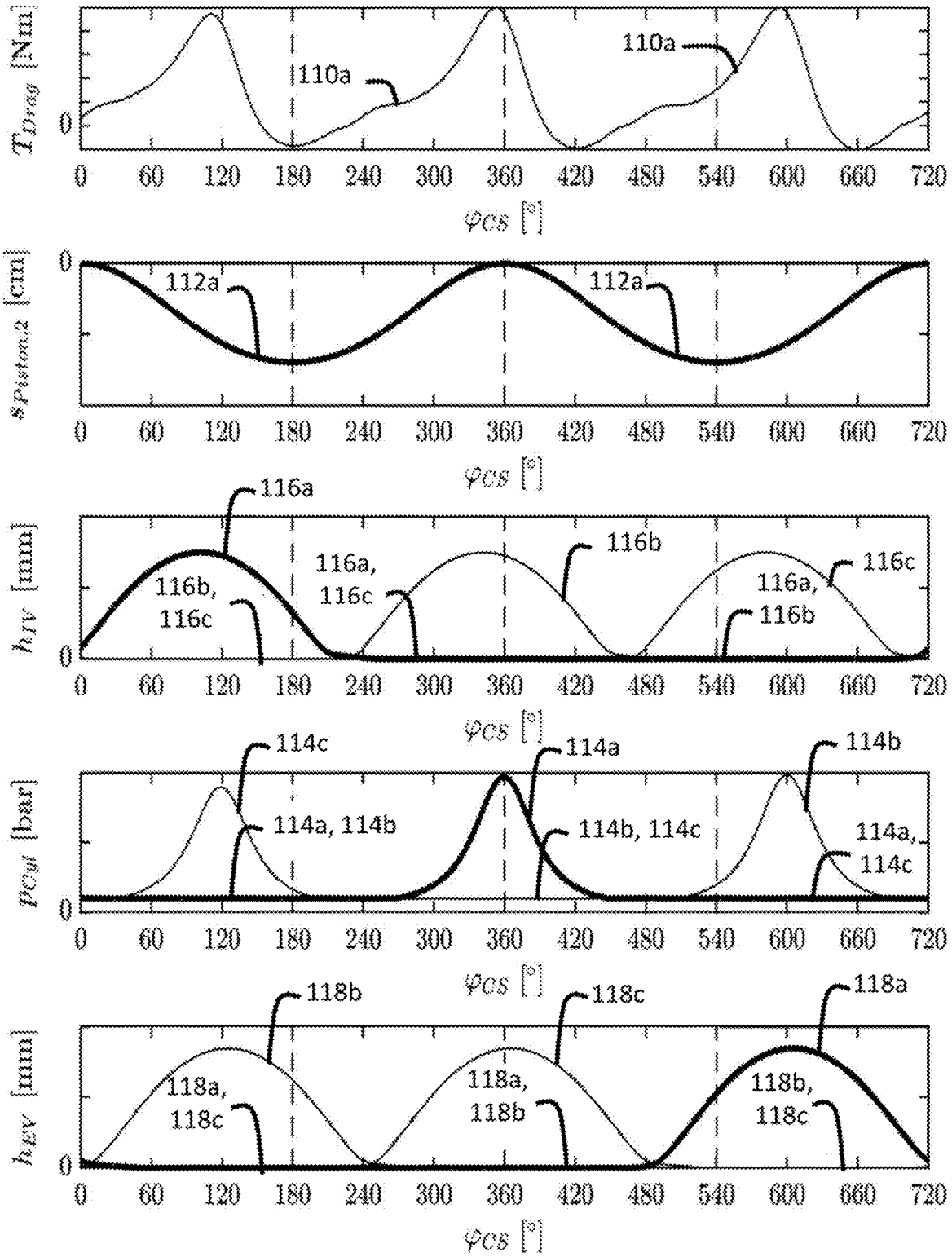
FIG. 1 shows the behavior of a four-stroke three-cylinder internal combustion engine having an evenly distributed firing sequence.

Starting Procedure of an Internal Combustion Engine Using a Crankshaft-Mounted Electric Turning Machine Electric turning machines (ETM) in the powertrain have recently been used in the start of internal combustion engines (ICE). For the following considerations, the powertrain arrangement for a vehicle is defined as a P1 or P2 hybrid configuration, shown in FIG. 2. In the P1 hybrid, the ETM is rigidly connected to the ICE, whereas in the P2 hybrid, a second clutch allows a decoupling of the ETM from the ICE.

In more details, a powertrain 200 comprises an ICE 210, an ETM 220, a gearbox 230, an inverter 240, a battery 250, at least one clutch 260, and an engine control unit (ECU) 270. The P1 hybrid configuration includes a single clutch 260. The P2 hybrid configuration includes an additional clutch 270. The ICE 210 is a four-stroke engine having any number of cylinders 12 (three cylinders are shown) and having an evenly distributed firing sequence. The cylinders 12 are contained in a cylinder block 14. Each cylinder 12 has a piston 16 disposed therein. Each piston 16 can reciprocate within its respective cylinder 12 to change the volume of a combustion chamber 18 associated with the cylinder 12. Each piston 16 is coupled via a connecting rod 20 to a crankshaft 22 journaled in a crankcase 24, such that combustion of fuel in the combustion chambers 18 forces the pistons 16 downward to cause rotation of the crankshaft 22. A number of valves 28 are provided in the cylinder head 26 for each cylinder 12, some of which allow fuel to enter the combustion chambers 18 for combustion therein, and others of which allow exhaust gases to exit the combustion chambers 18 after combustion has occurred. The opening and closing of the valves 28 is controlled by a camshaft 30, which is driven by the crankshaft 22 via a chain 32. An injection system 34 (schematically shown) controlled by the ECU 270 is used to inject fuel in the cylinders 12 and an ignition system 36 (schematically shown) controlled by the ECU 270 is used to ignite the fuel injected in the cylinders 12. A sensor 38 (or plural sensors 38) may be used to detect an angular position and a rotational speed of the crankshaft 22. Use of one or more sensors capable of detecting an angular position and a rotational speed of another component of the ICE 210 or of the ETM 220, is also contemplated, inasmuch as the rotational speed and angular position of the crankshaft 22 may be determined using measurements from the other one or more sensors.

Figure 2:
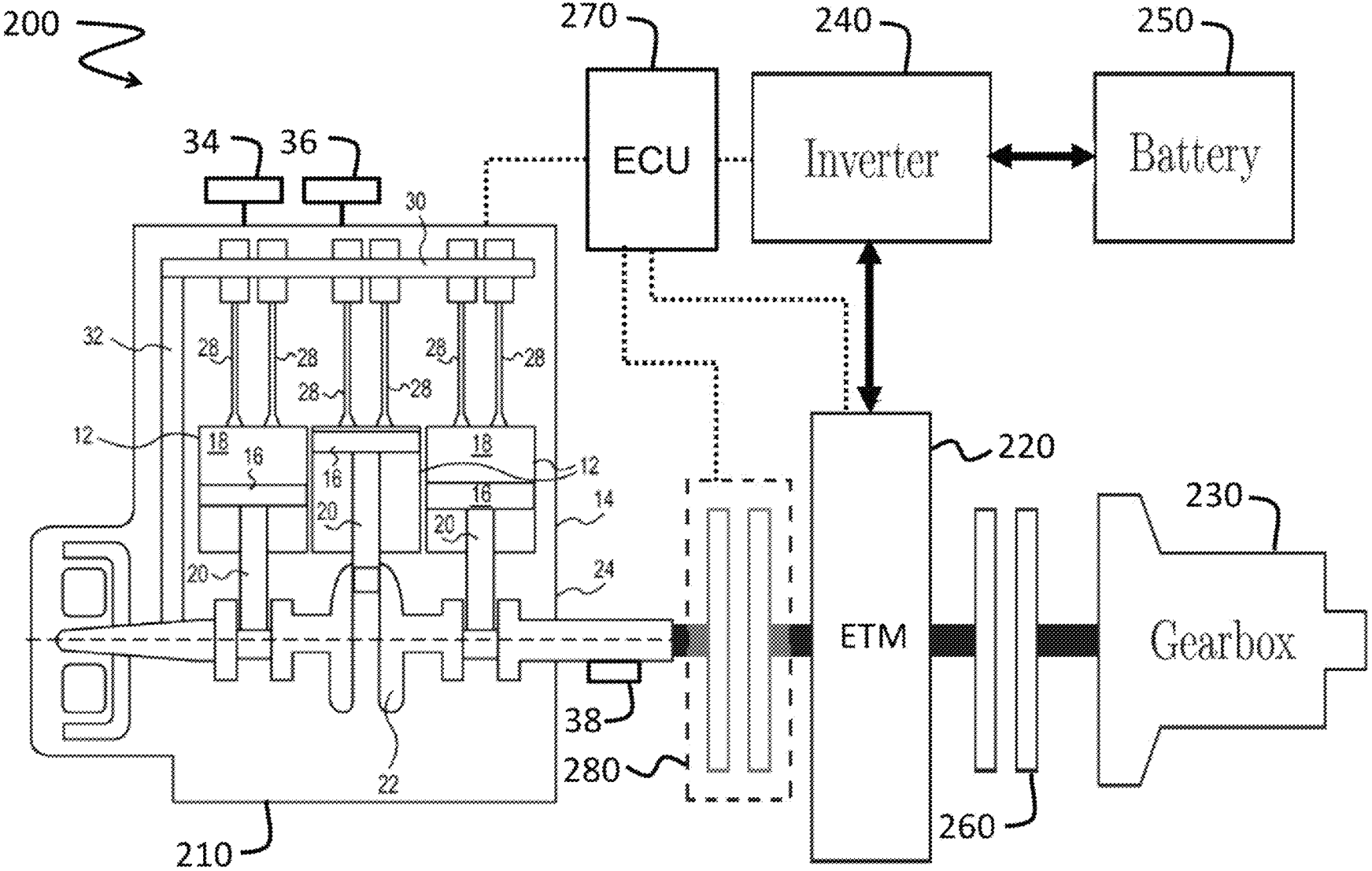
FIG. 2 is a block diagram of a powertrain arrangement of a hybrid vehicle in accordance with an embodiment of the present technology.

As indicated using dotted lines on FIG. 2, the ECU 270 is operatively connected to the ICE 210, to the ETM 220, the inverter 240, and the clutch 280 (if present), for sending control commands and for receiving measurements and statuses from sensors (not shown) imbedded in these components of the powertrain 200. On FIG. 2, thick arrows between the ETM 220, the inverter 240 and the battery 250 illustrate how power may be exchanged bidirectionally between these components.

The ETM 220 is mainly used for starting the ICE 210. To this end, power from the battery 250 is converted by the inverter 240 and supplied to the ETM 220 for rotating the crankshaft 22. Once the ICE 210 has been started, the ETM 220 is driven by the crankshaft 22 and used as a generator to recharge the battery 250 via the inverter 240. As such, in an embodiment, the ETM 220 is as small as possible due to cost reasons. Despite the small size, the maximum generator power available from the ETM 220 should generate sufficient torque for the cranking process of the ICE 210.

For these reasons, a procedure for facilitating the starting process is introduced. This procedure allows the ETM 220 to be designed with much lower maximum torque than would conventionally be needed for the start of the ICE 210.

In an embodiment, the powertrain 200 includes a standard lead 12 V battery 250. This allows the well-integrated low-voltage on-board electric system of a vehicle comprising the powertrain 200 to be used directly as usual, without the need for a voltage conversion via a DC/DC converter from a 48 V or higher-voltage on-board power supply. Given the relatively low voltage battery 250, levels of current flowing from the battery 250 to the inverter 240 and then to the ETM 220 may result in significant power losses on the cables between the battery 250, the ETM 220 and the inverter 240. In order to be able to provide the desired cranking power, a high electric current is accordingly used in the low-voltage on-board electric system. As a result, the power loss $P_{L,Cable}$ via the cable being proportional to the square of the electric current I, according to the following formula:

$$P_{L,Cable}=UI=RI^2$$

Accordingly, the cable resistance $$R_{Cable}=\rho_{Cu}\frac{l}{A}$$

is kept as small as possible, using short cable lengths l and corresponding cross sections A.

Figure 3:
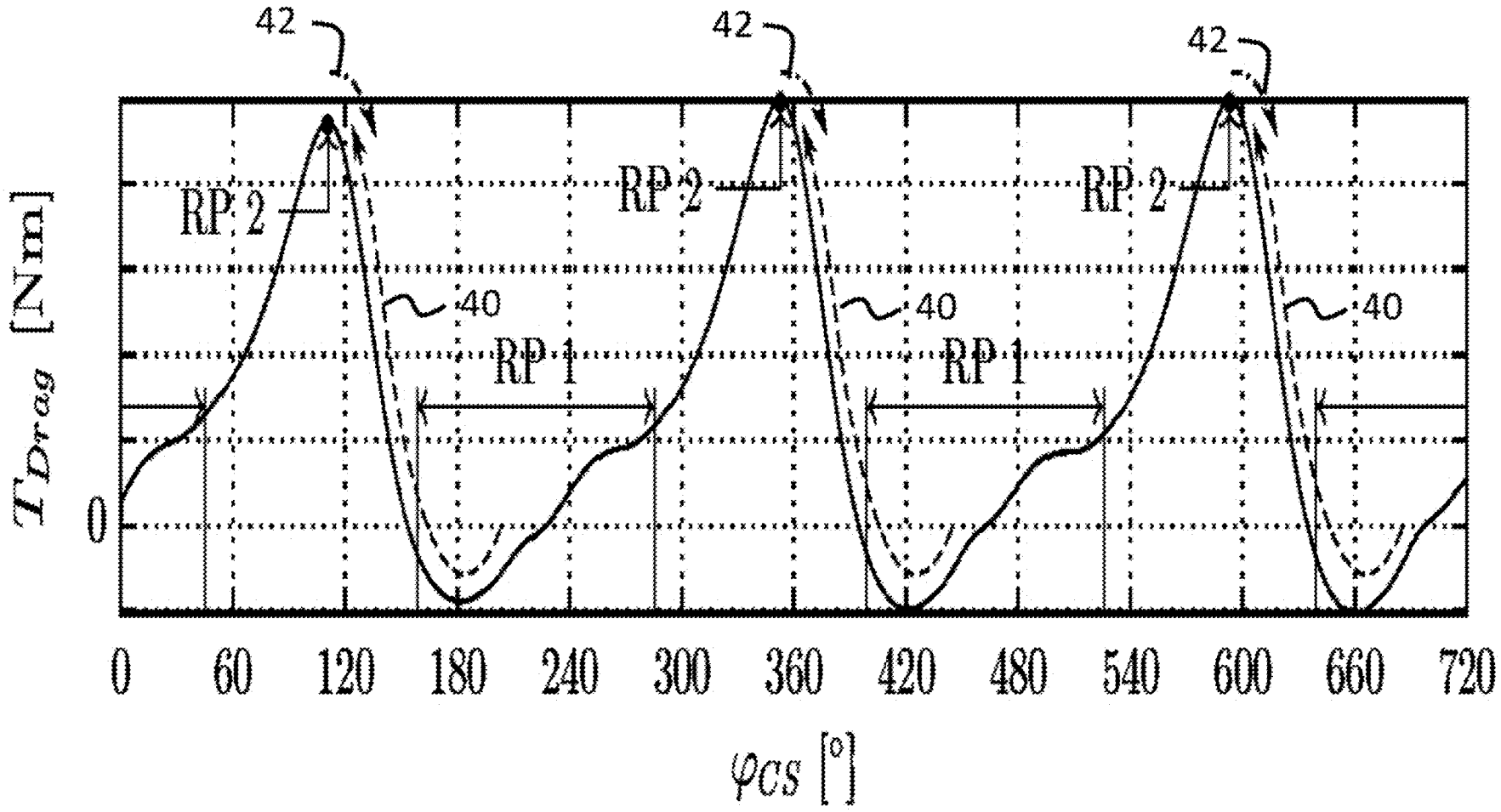
FIG. 3 is a graph showing values of the drag torque applied on the crankshaft of the ICE at various possible rest positions.

The present disclosure introduces two processes for improving the startability that may be used for a four-stroke ICE 210 having an evenly distributed firing sequence, regardless of the design, type and number of cylinders 12. Possible rest positions of the crankshaft 22 are of importance for the starting process and will be considered in more detail below. For this purpose, the drag torque $T_{Drag}$ shown in FIG. 3 is used for illustrative purposes using an example of a three-cylinder ICE 210. It shows the possible rest positions in which the crankshaft 22 may come to a standstill when it is not driven. First rest positions (RP1) of the crankshaft 22 are those positions in which pressures in the combustion chamber 18 reduce towards zero, given that the energy contained in the compression causes the crankshaft 22 to move and settle in a position where no expansion-forces act on the pistons 16. The first rest positions RP1 indicate an approximate range and vary depending on the number and structure of the cylinder or cylinders 12. The first rest positions RP1 are determined separately for each engine type. Second rest positions (RP2) describe the less likely, but possible cases, where the crankshaft 22 may also come to a standstill at a point where the drag torque $T_{Drag}$ is at a local maximum. A starting process is described below, in which first the first rest positions in the area RP1 and the second rest positions RP2 are both considered. On FIG. 3, the dashed lines 40 show the direction in which the crankshaft 22 may be rotated in the case of the rest position RP1 in order to extend the acceleration path. On FIG. 3, arrows 42 indicate the crankshaft rotation direction in case of rest position RP2.

In most ICEs, for historical reasons, the traditional rotational direction of the crankshaft 22 is clockwise when looking at a front end of the crankshaft 22, a flywheel being optionally mounted on a rear end of the crankshaft 22. Therefore, the clockwise rotation (also defined in the present disclosure as a positive direction of rotation) and the counterclockwise rotation (also defined as a negative direction of rotation) are used for the following considerations. These considerations are for explanation purposes and the present technology may also be applied to ICEs having crankshafts normally rotating in the opposite direction.

Using the Mass Moment of Inertia for Facilitating the Starting Procedure

Starting from the first rest position RP1 (although the initial position of the crankshaft 22 does not have to be known), the crankshaft-mounted ETM 220 is used to start the ICE 210. Since the ETM 220 is used as a generator after the ICE 210 has been started, it is also referred to as a starter-generator. The starting procedure described below differs from a conventional starting procedure, in which a pinion starter causes the crankshaft 22 to rotate at first in the clockwise direction of rotation. The present technology operates in a different manner. In order not to allow the ETM 220 to travel directly into the compression phase of the cylinder 12, which necessitates a maximum torque to be delivered by the ETM 220 operating as a starter and a corresponding highest current to be consumed by the ETM 220, the crankshaft 22 is rotated in a first direction (the counterclockwise direction of rotation) so that it will benefit from a longer acceleration path when later rotated in a second direction (the clockwise direction of rotation). This procedure uses the mass inertia of the rotating crank drive, the camshaft 30 and the driven components, to be able to overcome a local maximum of the drag torque $T_{Drag}$. The masses of the crank drive include the crankshaft 22 with balancing weights, as well as masses of the connecting rods 20 and of the pistons 16. The masses of the driven components include oil pump, water pump, clutch, torque converter or variator. Depending on the design, the optional flywheel may be omitted for the ETM 220 (starter generator), as rotational irregularities of the crankshaft 22 may be compensated directly with the ETM 220.

Figure 4:
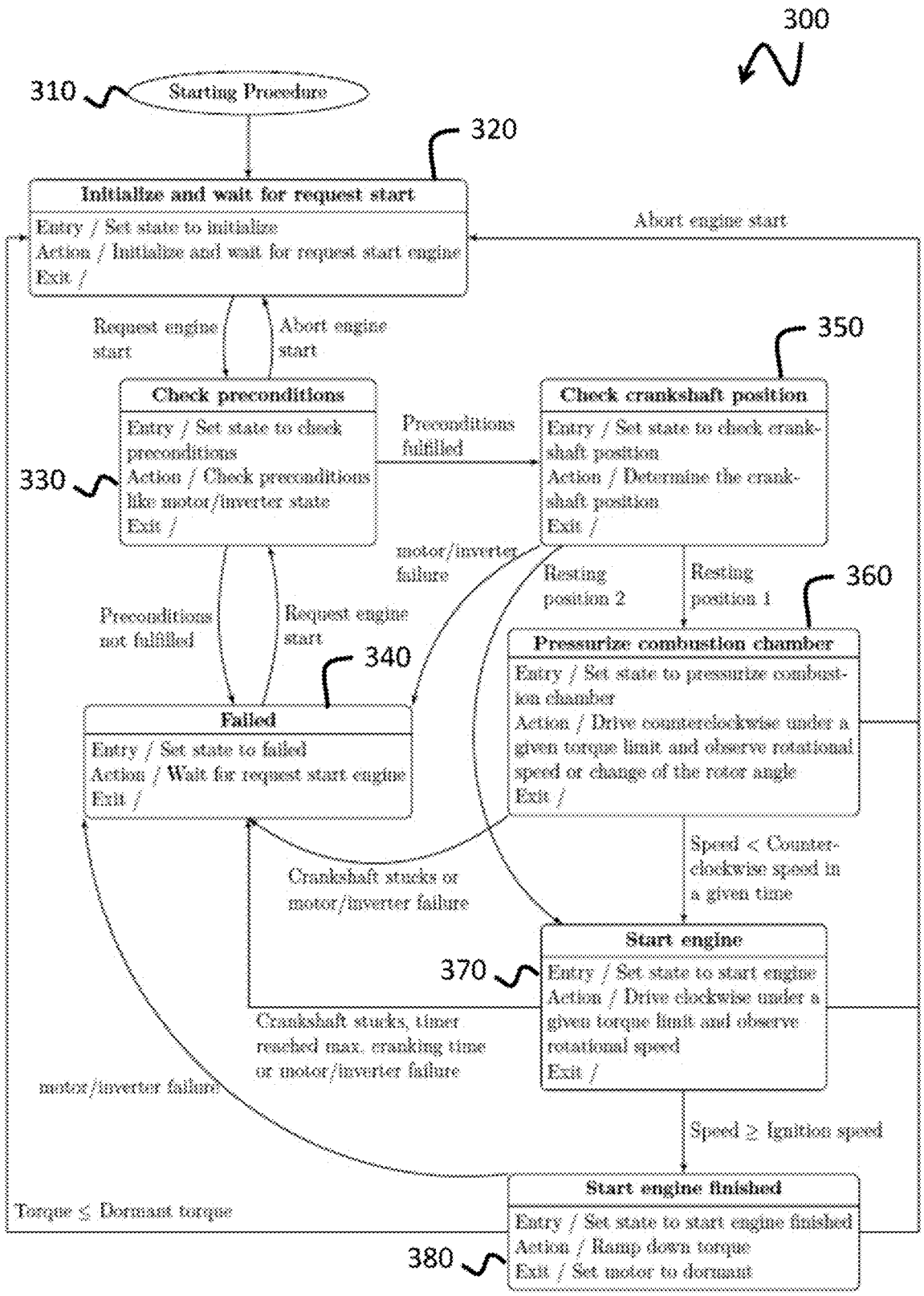
FIG. 4 is a state diagram for the starting procedure of an internal combustion engine using an electric turning machine in accordance with an embodiment of the present technology.

The state diagram of FIG. 4 shows a sequence 300 of the starting procedure. The sequence 300 comprises a plurality of operations, some of which may be executed in variable order, some of the operations possibly being executed concurrently, some of the operations being optional. In an embodiment, most operations of the sequence 300 may be controlled by the ECU 270 (FIG. 2). The starting procedure is initiated at operation 310, when the ECU 270 is first energized, usually a very brief time before a start request from a vehicle operator. At operation 320, the ECU 270 executes an initialization sequence and becomes ready to receive an actual start request. Having received the start request, the ECU 270 initiates operation 330, in which a number of preconditions of the powertrain 200 may be checked. The preconditions may comprise, for example and without limitation, verifying that there is no previously stored fault conditions related to the ICE 210, the inverter 240, the ETM 220, and the like. Should one or more of the preconditions be unmet at operation 330, the starting procedure fails and the sequence 300 continues at operation 340, where the ECU 270 sets an internal state to indicate that the starting procedure has failed and the starting procedure is stopped. The ECU 270 waits for another engine start request at operation 340. If a new start request is received at operation 340, the sequence 300 continues at operation 330, where the preconditions are checked once again. The sequence 300 may also return from operation 330 to operation 320 if the ECU 270 receives an indication that the vehicle operator has aborted the start procedure.

If the preconditions are fulfilled, the sequence 300 moves to operation 350. In operation 350, the ECU 270 verifies the current crankshaft angular position. Various techniques that may be used to determine the crankshaft angle are described hereinbelow. The ICE 210 being stopped at the time, the crankshaft 22 is expected to be at one or the two position resting positions RP1 and RP2. If the crankshaft 22 is in the resting position 1 (RP1), the sequence continues at operation 360. If the crankshaft 22 is in the resting position 2 (RP2), the sequence continues at operation 370. If the ECU 270 detects a failure of the ICE 210, of the inverter 240, or another failure of the powertrain 200, the sequence 300 moves to operation 340 where the ECU 270 waits for another engine start request.

At operation 360 (the crankshaft 22 being at RP1), the combustion chamber of the ICE 210 is pressurized by causing a counterclockwise rotation of the crankshaft 22, under a given torque limit. A rotational speed of the crankshaft 22, or an angle of the crankshaft 22, may be observed to verify that the crankshaft 22 is not rotated using an excessive torque, and that it is not rotated beyond a reversal point, which is defined hereinbelow. The counterclockwise rotation of the crankshaft 22 is controlled by the ECU 270, which causes delivery of electric power from the battery 250 to the ETM 220 via the inverter 240. The ECU 270 may control the inverter 240 to prevent application of an excessive torque on the crankshaft 22. If the clutch 280 is present, the ECU 270 may also cause the clutch 280 to apply an effective connection between the crankshaft 22 of the ICE 210 and a rotor (not shown) of the ETM 220. It may happen that the crankshaft 22 is stuck and fails to rotate, or that the ETM 220 or the inverter 240 fails to operate. In such cases, the sequence 300 moves to operation 340 where the ECU 270 waits for another engine start request. The sequence 300 may also return from operation 360 to operation 320 if the ECU 270 receives an indication that the vehicle operator has aborted the start procedure.

When operation 360 is properly executed, the crankshaft 22 is rotating in a counterclockwise direction at a low speed. The sequence continues at operation 370. This operation 370 may be reached after operation 360, or directly after operation 350 if the ECU 270 has determined that the crankshaft 22 is in the resting position 2 (RP2), the sequence continues at operation 370. At operation 370, the ECU 270 causes delivery of electric power from the battery 250 to the ETM 220 via the inverter 240 for causing a clockwise rotation of the crankshaft 22. The ECU 270 may control the inverter 240 to maintain a torque applied on the crankshaft 22 below a torque limit. The rotational speed of the crankshaft 22 is monitored at operation 370 in view of reaching a minimum ignition speed. Operation 370 may fail if the crankshaft 22 refuses to rotate, if the crankshaft 22 fails to reach the minimum ignition speed after a predetermined time limit, or if the ETM 220 or the inverter 240 reports a failure to the ECU 270. In case of any failure of operation 370, the sequence 300 moves to operation 340 where the ECU 270 waits for another engine start request. The sequence 300 may also return from operation 370 to operation 320 if the ECU 270 receives an indication that the vehicle operator has aborted the start procedure.

Provided that the rotational speed of the crankshaft 22, rotating in the clockwise direction, meets or exceeds the minimum ignition speed at operation 370, the sequence 300 continues at operation 380, in which the ICE 210 is started by injecting and igniting fuel in its cylinder(s) 12. Operation 380 may also fail if the ETM 220 or the inverter 240 reports a failure to the ECU 270, in which case the sequence 300 moves to operation 340 where the ECU 270 waits for another engine start request. If operation 380 is successful, the ICE 210 is now in operation and the ECU 270 ramps down the torque applied by the ETM 220 on the crankshaft 22 below a dormant torque threshold. The ETM 220 may now be used as generator to recharge the battery 250 via the inverter 240. The sequence 300 may also return from operation 380 to operation 320 if the ECU 270 receives an indication that the vehicle operator has aborted the start procedure.

Considering the sequence 300 of FIG. 4, the power electronics (inverter 240) connected to the ETM 220 may be controlled by the ECU 270 to set the desired voltages and currents for the ETM 220. After a successful starting process, the voltage induced in the ETM 220 is rectified by the inverter 240 to supply the electrical loads in the vehicle electric system and to charge the battery 250. In operation 360, if the crankshaft 22 rests in a first rest position RP1, the ECU 270 checks for errors after the driver's start request and starts the cranking procedure in the fault-free case. For this purpose, an electric current corresponding to a desired speed in the counterclockwise direction of crankshaft rotation is applied to the ETM 220, without exceeding the local maximum value of the drag torque $T_{Drag}$. The path to be traced by the drag torque $T_{Drag}$ resulting from the counterclockwise rotation of the crankshaft 22 is shown in FIG. 3 (dashed lines 40). The desired speed in the counterclockwise direction of crankshaft rotation and the corresponding current are determined depending on the ETM 220, the type of ICE 210 and the ICE temperature.

Reaching a position where the drag torque $T_{Drag}$ approaches its local maximum, defined as a reversal point, the speed of the crankshaft 22 decreases again. The reversal point depends on various factors, such as the type of the ICE 210, and may differ for various engine types. For the example of the three-cylinder ICE 210 in FIG. 1, one possible reversal point is in the range of approximately 360°, where the drag torque $T_{Drag}$ is near its local maximum. The inverter 240 limits the desired speed in the reverse direction and the corresponding current in such a way that the powertrain 200 may handle a rotational direction reversal, shortly before the local maximum drag torque. The crankshaft 22 thus rotates in the counterclockwise direction until this local maximum drag torque point is substantially reached, optionally verifying that a certain minimum time has elapsed while the crankshaft 22 is actually moving, before the next operation is processed. Checking the elapsed time may protect the engine in case the crankshaft 22 is stopped, in which case the starting process may be aborted and a status is changed to a fault state. The maximum duration of the rotation in counterclockwise direction may also be observed in order not to rotate the crankshaft 22 in the counterclockwise direction beyond the reversal point.

Continuing with the fault-free case, in a next operation 370, a predefined electric current for a corresponding desired torque for rotating the crankshaft 22 in the clockwise direction is determined so that the crankshaft 22 may reach a sufficient speed for a successful start of the ICE 210 as quickly as possible. The duration of this process may be verified in order to be able to abort the starting process in the case of a non-starting ICE 210, in order to protect the engine from damage and in order not to over discharge the battery 250. In addition, another possible fault case in which the sufficient speed for starting is not reached within a certain time is also verified. If this happens, the crankshaft 22 may be stuck and the starting process is aborted. If the self-running speed of the ICE 210 is reached in the fault-free case, the torque of the ETM 220 is linearly reduced, to ensure a smooth transition, and put the motor function of the ETM 220 into standby state afterwards, the ETM 220 used as a generator to recharge the battery 250.

If the starting process starts in the less likely second rest position RP2, as shown in FIG. 3, the starting procedure is shortened. If it is determined at operation 350 that the crankshaft 22 rests in the second rest position RP2, the crankshaft 22 is directly accelerated in clockwise direction of rotation (arrows 42) at operation 370. The procedure may continue, as described hereinabove, without the operation of the counterclockwise rotation.

There are several possibilities to prevent exceeding the reversal point, just before the local maximum drag torque, when rotating the crankshaft 22 in the counterclockwise direction of rotation. If the available space and costs allow, it is possible to mount an angle sensor on the camshaft 30 so that the angle of the crankshaft 22 may be clearly determined. For this purpose, for example, a radially magnetized magnet may be attached to the camshaft 30. The angular position of the camshaft 30 may thus be determined electronically. Sensorless methods are listed further down. Since the camshaft 30 rotates at half the crankshaft speed, the angle of the crankshaft 22 may be clearly determined over two complete revolutions. It is also possible to measure the position of the crankshaft 22 using another accessory engine component that is driven by the crankshaft 22 and that rotates at half the crankshaft speed by means of a gear reduction.

Figure 5:
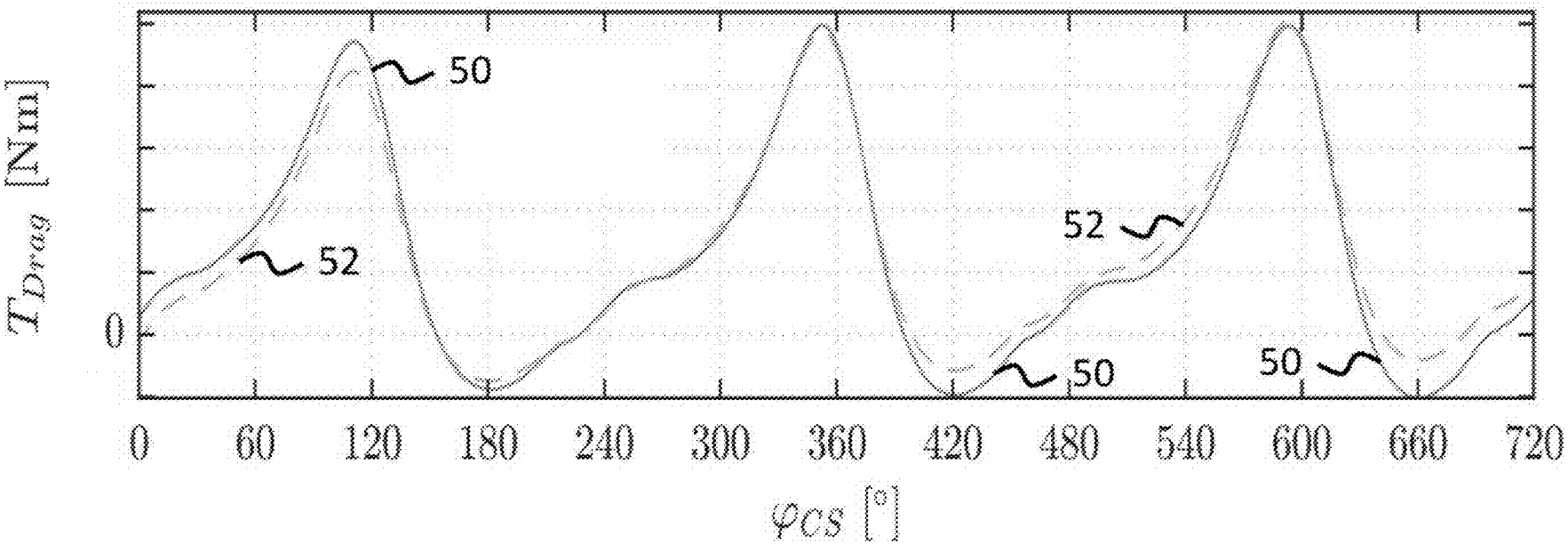
FIG. 5 shows an example of how an increase in temperature of the combustion engine affects the drag torque.

The variation of the drag torque $T_{Drag}$ over the rotation of the crankshaft 22 and the maximum of the drag torque are strongly dependent on the structure of the ICE 210, the oil viscosity, the temperature of the ICE 210, or the oil temperature. FIG. 5 shows an example of how an increase in temperature of the ICE 210 affects the drag torque $T_{Drag}$. On FIG. 5, drag torque $T_{Drag}$ curves are provided at different temperatures using the example of the three-cylinder inline internal ICE 210. A curve 50 shows how the drag torque $T_{Drag}$ varies according to the crankshaft angle $\varphi_{CS}$ when the engine is cold and a curve 52 shows how the drag torque $T_{Drag}$ varies according to the crankshaft angle $\varphi_{CS}$ when the engine is hot.

When rotating in the negative crankshaft direction, in order not to exceed the reversal point that corresponds to different drag torque values at different temperatures, the drag torque $T_{Drag}$ may be measured at different temperatures and the speed of counterclockwise crankshaft rotation and the corresponding electric current supplied to the ETM 220 are predetermined in such a way, that the reversal point is not exceeded, even at different temperatures. A possible enhancement of this variant is to determine the sufficient speed and corresponding electric current as a function of temperature and to have them pre-set in the inverter. The temperature of interest may be an ambient temperature, an engine coolant temperature, an engine oil temperature, air temperature in an intake of the engine, and the like. Regardless, at colder temperatures, the local maximum drag torque may initially be greater than at warm temperatures. A maximum torque provided by the ETM 220 should correspond at least to a maximum rotational energy sufficient to bring the crankshaft 22 to the reversal point at expected operational conditions, including an expected temperature range. This may be considered when selecting the characteristics of the ETM 220.

Furthermore, it is possible to use existing signals for the control, such as a camshaft signal or a crankshaft signal. These signals are conventionally available in order to correctly determine injection and ignition times, for example. The camshaft signal may be used to determine the rotational angle of the crankshaft 22 of the 4-cycle engine within a 720° cycle (i.e. even or uneven number of crankshaft revolutions). This angular information may also be used to control the ETM 220. For an ICE 210 with an even number of cylinders 12, the information from the camshaft signal or from the crankshaft signal is sufficient. Because of the number z of cylinders 12, it is known that at a crankshaft angle of 720° (corresponding to two full crankshaft revolutions), the maximum of the drag torque has occurred exactly z times. The drag torque $T_{Drag}$ for these cases varies over a period calculated as 720°/z.

Figure 6:
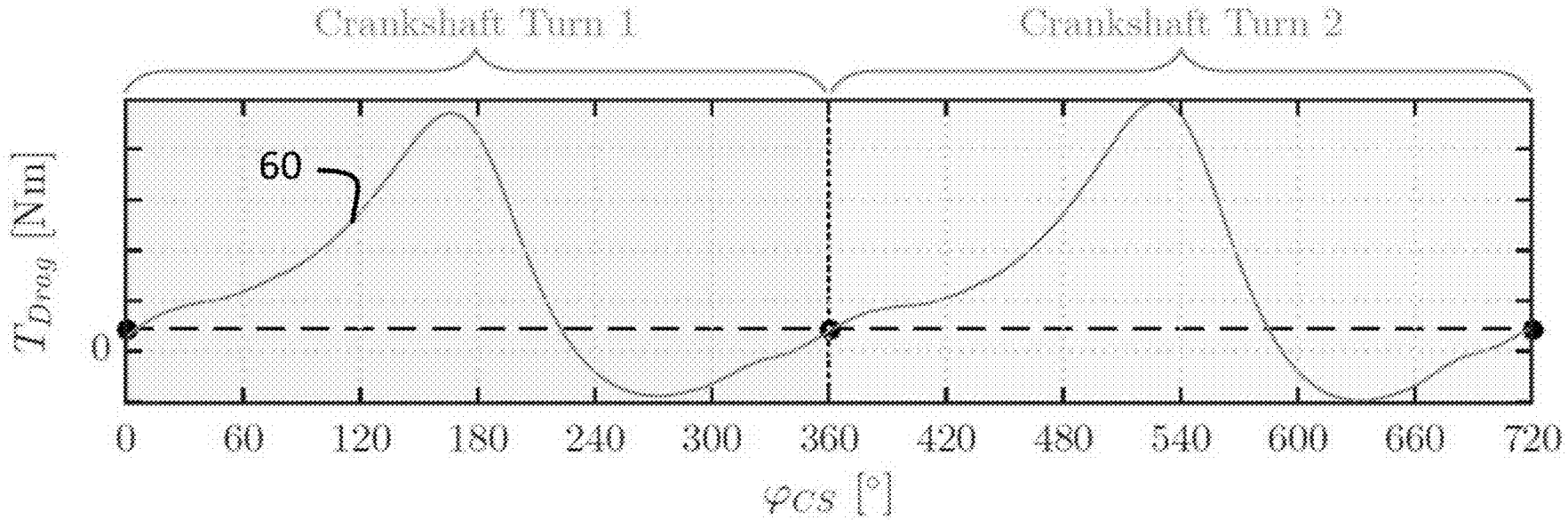
FIG. 6 illustrates variations of the drag torque $T_{Drag}$ of a two-cylinder inline (parallel-twin) internal combustion engine.

On FIG. 6, curve 60 shows a drag torque $T_{Drag}$ of a two-cylinder inline (parallel-twin) ICE 210 as a function of a crankshaft angle $\varphi_{CS}$. Using a two-cylinder ICE 210 as an example, as may be seen in FIG. 6, this means that the drag torque $T_{Drag}$ has its maximum once every 360°, and the drag torque $T_{Drag}$ pattern repeats after every 360°. Therefore, the crankshaft signal is sufficient to determine the position of the crankshaft 22. In order not to exceed the reversal point when rotating the crankshaft 22 in counterclockwise direction of rotation, angles may be specified, depending on the type of ICE 210.

In the case of an odd number z of cylinders 12, including single-cylinder engines (z=1), either the camshaft signal, or both the crankshaft signal and the camshaft signal, are used to determine the angular position of the crankshaft 22. An integer number of periods of the drag torque $T_{Drag}$ does not occur within 360° when the number z of cylinders 12 is odd, and the drag torque $T_{Drag}$ pattern is fully repeated only after 720°. The camshaft signal and the crankshaft signal provide information in which of even or uneven revolutions the crankshaft 22 is currently located. As a non-limiting example, considering the curve of the drag torque $T_{Drag}$ in the cold state of the three-cylinder ICE 210 from FIG. 5, the first crankshaft revolution corresponds to the angular range from 0° to 360°, the second revolution corresponds to the angular range from 360° to 720°. Depending on the crankshaft revolution, the paths to the reversal point differ. Using the camshaft signal, the path to the reversal point may be determined and the maximum path for rotating the crankshaft 22 in the counterclockwise direction of rotation may be determined depending on the situation.

In other examples, for example when sensor information is not available due to space or cost reasons, the following methods may be used. However, the methods are also applicable for a setup with an angle sensor. One possibility is to determine a predetermined speed and a predetermined level of electric current such that, regardless of the temperature, the reversal point is not exceeded when the crankshaft 22 rotates in counterclockwise direction. Instead of the angle of crankshaft rotation, a variation of the crankshaft speed rotating in the counterclockwise direction may be observed. When approaching the local maximum drag torque while in the counterclockwise rotation, the speed of the crankshaft 22 decreases and would reach zero at the reversal point. A speed limit a is set for the counterclockwise rotation of the crankshaft 22, a being a parameter to be determined depending on the characteristics of the engine and of the ETM 220. When the decreasing speed of the crankshaft 22 reaches $\alpha$, appropriate operations are initiated to accelerate the crankshaft 22 in the clockwise direction for starting the engine. In addition to the condition that the speed has reached a certain value $\alpha$, acceleration of the crankshaft 22 in the clockwise direction of rotation takes place when a certain amount of time—defined as a predetermined minimum compression time—has elapsed. Checking this minimum duration serves as protection against a situation where the crankshaft 22 is stuck or is accelerating too slowly in the counterclockwise direction of rotation. In this fault case, the speed condition (speed reduced to $\alpha$) would be fulfilled even though the crankshaft 22 has not yet sufficiently moved in the counterclockwise direction of rotation. Furthermore, a predetermined maximum compression time is also determined and observed so that the reversal point is not exceeded, otherwise the system switches to the fault state.

Figure 7:
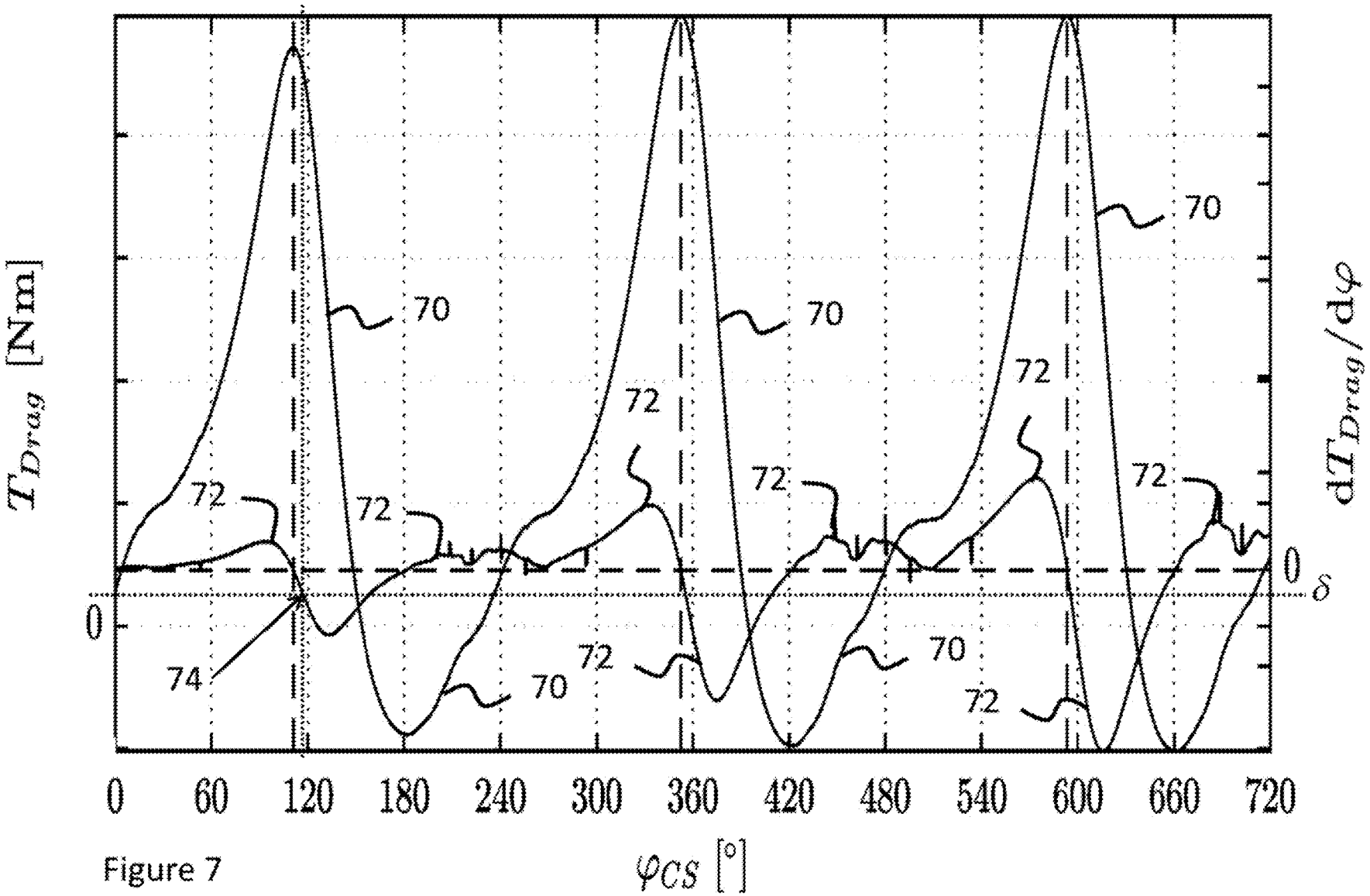
FIG. 7 illustrates variations of the drag torque $T_{Drag}$ and of a first derivative $dT_{Drag}/d\varphi$ of the drag torque using the example of the three-cylinder inline internal combustion engine.

Another possibility, similar to the just presented variant, is to consider the derivative (or gradient) of the drag torque $dT_{Drag}/d\varphi$ instead of the speed. The electric current applied to the ETM 220 is proportional to the drag torque $T_{Drag}$, which is shown on FIG. 7 as a function of the crankshaft angle $\varphi_{CS}$, on curve 70. The scale of the drag torque $T_{Drag}$ is shown on the left vertical axis. The change in drag torque $T_{Drag}$ may thus be inferred from the change in electric current. The derivative of the drag torque $dT_{Drag}/d\varphi$ is shown on FIG. 7 as a function of the crankshaft angle $\varphi_{CS}$, on curve 72. The scale of the derivative of the drag torque $dT_{Drag}/d\varphi$ is shown on the right vertical axis. If the crankshaft 22 is rotated from the first rest position RP1 in the counterclockwise direction, the drag torque $T_{Drag}$ steadily increases. Since the derivative of the drag torque $dT_{Drag}/d\varphi$ is shown on curve 72 for a clockwise direction of rotation, it may be regarded as inverted when the crankshaft 22 is rotated in the counterclockwise direction.

The change in the drag torque $T_{Drag}$ reaches a minimum value shortly before the reversal point and then increases again, until it approaches zero at the reversal point. Based on this information, a threshold value $\delta$ may be specified again, such that the reversal of the direction of rotation of the crankshaft 22 is initiated as soon as the change in drag torque $T_{Drag}$ (curve 72) reaches $\delta$ (at point 74 for example). In addition to this condition, it may be verified that a certain minimum duration has also elapsed again, since otherwise the initial high change in drag torque $T_{Drag}$ when the crankshaft 22 moves from standstill would incorrectly satisfy the condition. As mentioned in the above description of the methods, it is also possible to predetermine values depending on engine temperature in order to prevent rotating the crankshaft 22 in the counterclockwise direction beyond the reversal point.

Alternatively, it is also possible to consider a time-dependent derivative $d\varphi/dt$ of the crankshaft angle. This variant, like the previous ones, may also depend on the engine temperature, since a temperature difference affects the variation of the drag torque. The higher the temperature, the faster the crankshaft 22 rotates when a given electric current is supplied to the ETM 220. If the crankshaft 22 is accelerated from the first rest position RP1 in the counterclockwise direction of rotation, the time-dependent derivative $d\varphi/dt$ of the crankshaft angle increases. When approaching the reversal point, the compression force increases and decelerates the crankshaft rotation, such that $d\varphi/dt$ reaches zero at the reversal point. If the condition $d\varphi/dt<\delta$ is fulfilled, the process is continued by accelerating the crankshaft 22 in clockwise direction of rotation. As the condition $d\varphi/dt<\delta$ is already satisfied at crankshaft standstill, i.e. before the crankshaft 22 starts rotating counterclockwise, the control method may include a verification that a certain minimum time has elapsed before the direction of rotation is reversed.

Alternatively, when the crankshaft signal or the camshaft signal is not available or does not provide angular information with sufficient precision, the angular position of the crankshaft may be determined based on the angular rotor position of the ETM 220. The angular rotor position of the ETM 220 may be determined without using a sensor, at standstill or at low speed. To this end, a high-frequency signal may be injected into the ETM 220 and a response signal from the ETM 220 may be analyzed. Individual phase inductances of rotary field machines are mostly different because they depend on the position of the rotor. This dependence may be used for the estimation of the rotor position, at low speeds and even for zero speed. Since the back-electromotive force (EMF) increases with higher speeds, the information of the measured voltages and currents may be used to determine the rotor position. Depending on various factors, for example system setup, system dynamics, and performance of a signal processor in the ECU 270, non-adaptive or adaptive procedures, such as a back-EMF model, a Kalman-filter or a Luenberger-filter, may be used for estimating the rotor position.

Regardless of the manner in which the reversal point is determined, this starting procedure provides that, in addition to the torque of the ETM 220, the rotational energy $$E_{rot}=\tfrac{1}{2}J\omega^2,$$

Is built up due to the mass moment of inertia of the rotating crankshaft 22, the camshaft 30 and the driven components, in which co is the angular speed of the crankshaft 22 and J the moment of inertia of these components. The introduction of the most relevant masses may be achieved by writing down the kinetic energy, followed by replacing the velocity v with ωr, since a rotational movement takes place here, which leads to $$E_{kin}=\frac{1}{2}\sum_i m_i v_i^2=\frac{1}{2}(m_{CD}v_{CD}^2+m_{CM}v_{CM}^2+m_D v_D^2)=$$
$$\frac{1}{2}(m_{CD}\omega^2 r_{CD}^2+m_{CM}\omega^2 r_{CM}^2+m_D\omega^2 r_D^2)=$$
$$\frac{1}{2}\left(\underbrace{m_{CD}r_{CD}^2+m_{CM}r_{CM}^2+m_D r_D^2}_{J}\right)\omega^2.$$

Let $m_{CD}$, $m_{CM}$ and $m_D$ or $r_{CS}$, $r_{CM}$ and $r_D$ be the masses or radii of the crank drive, the camshaft 30 and the driven components. The rotation of the crankshaft 22 in the counterclockwise direction before the rotation in the clockwise direction leads to an already initially higher speed $n_{CS}(t)$, at the same point, as compared to a start procedure with a freewheel starter.

Depending on the type of ICE 210, potential energy may be built up. Considering the example of a single cylinder ICE 210, a potential energy is built up due to the acceleration of the masses via the piston stroke s, during the period until a piston 16 has moved from the bottom to the top dead center. At the point of reversal, where the piston 16 has covered the maximum distance of s, the potential energy is maximized.

The described process allows the static torque of the ETM 220 to be smaller than the local maximum drag torque of the ICE 210.

Using the Compression Phase for Facilitating the Starting Procedure

Another effect for a starting procedure considers the compression phases of the four-stroke process. FIG. 1 and FIG. 3 show that the drag torque $T_{Drag}$ is maximum at a point where the highest compression pressure $p_{Cyl}$ of the cylinder 12 occurs. The intake and exhaust valves 28 of the respective cylinder 12 are closed in this phase, and the piston 16 moving to top dead center compresses the gas in the combustion chamber. Starting from the first rest position RP1, the crankshaft 22 is expected to accelerate in the counterclockwise direction of rotation, as shown in FIG. 3. While the intake valve 28 is already closed, the initially open exhaust valve 28 begins to close, too. At the reversal point, the piston 16 is accelerated back downwards to the bottom dead center by the expansion of the compressed gas, whereby the potential energy of the compressed gas decreases and in turn the kinetic energy of the moving masses increases, until the piston 16 reaches bottom dead center. The kinetic energy now additionally supports the ETM 220 to accelerate the crankshaft 22 in the clockwise direction of rotation. Comparable to the compression of a gas pressure spring, this structure allows to store energy, which may be used for accelerating the crankshaft 22 in the clockwise direction. Possible gas losses due to small leakages of the valves 28 and piston rings determine the damping of this type of gas spring.

Without considering the minor influence of gas losses, the combustion chamber above the piston 16 may be regarded as a closed system in which the entire gas mass is compressed. According to the law of Boyle-Mariotte, the product of pressure $p_{Cyl}$ and volume Vin the combustion chamber is constant at constant temperature and quantity of substance, $p_{Cyl}$ equals a constant. FIG. 1 confirms this because, while the piston 16 moves upwards, the volume V above the piston 16 decreases and at the same time the pressure $p_{Cyl}$ increases. Without considering friction or dissipation of mechanical work into heat, the pressure-volume work results in $$W=-\int_{V_1}^{V_2} p_{Cyl}dV=-p_{Cyl}\Delta V.$$

V1 is the initial volume above the piston 16 and is referred to as V2 when the volume changes. When the crankshaft 22 is rotating in counterclockwise direction, the gas in the combustion chamber is compressed by volume reduction of $\Delta V=V2-V1<0$. This results in a positive compression work $W>0$, which means that work is added to the system. This means that the piston 16 performs work on the gas in the cylinder 12. After energy has been built up, there is a volume increase of $\Delta V=V2-V1>0$. This results in a negative work $W<0$, which means that the expansion results in work being delivered by the system.

This is the desired effect, which facilitates the starting procedure and, as with the use of mass inertia, allows selecting a significantly smaller ETM 220 that does not need to be able to overcome the local maximum drag torque of the ICE 210. Inserting the current crankshaft angle results in work $$W = -\int_{\varphi RP}^{\varphi RP1} p_{Cyl} \frac{dV}{d\varphi} d\varphi,$$

where $\varphi_{RP}$ is the angle of the reversal point and $\varphi_{RP1}$ the angle of the first rest position RP1.

The speed at which the crankshaft 22 is rotating in counterclockwise direction, is also relevant for building up energy. FIG. 1 shows that the exhaust valve 28 initially is still open when rotating the crankshaft 22 in the counterclockwise direction. Since only a certain amount of gas may escape, over the opening cross-section of the valve 28, in a certain time, namely the mass flow $$q_m = \frac{dm}{dt} = \rho \frac{dV}{dt} = \rho c_v A$$

the smallest amount of gas flows out of the cylinder 12 at maximum speed. Where ρ indicates the density of the medium, dV/dt the volume flow, $c_v$ the mean flow velocity and A the cross-sectional area of the valve outlet. If the crankshaft 22 is slowly rotating in counterclockwise direction, more gas may flow out of the combustion chamber due to the longer duration.

Some relevant effects that influence the process described hereinabove, are listed below:

- Gas may escape from the combustion chamber into the crankcase during compression through the piston rings, the so-called blow-by losses.
- The compression ratio $$\varepsilon = \frac{V_h + V_c}{V_c} > 1$$

which sets the total volume of the combustion chamber in relation to the compression volume, is a measure of the possible energy storage.
- The valve clearance is expected to ensure that the valves 28 are completely closed. If the valve clearance is too small, it may happen that the camshaft 30 causes a slight opening of the valve 28, even when it is supposed to be closed. In this way, gas may escape unintentionally from the combustion chamber and thus reduce the energy storage during the compression process.
- Possible gas losses via worn valve plates and valve seat rings.
- Depending on the connection of the crankshaft 22 with the camshaft 30, worn gears, timing belts or an elongated timing chain, may lead to delayed valve timing and thus affect the entire charge cycle.
- The lower the drag torque $T_{Drag}$ of the ICE 210, the faster the crankshaft 22 may be accelerated in counterclockwise and clockwise directions.
- The conditions of bearings and of other moving parts also affect the overall system.
- Furthermore, the condition and composition of the oil, as well as temperatures, also affect the system behavior.

The above-described procedures may be used to increase the energy for cranking the ICE 210, even in cases where the maximum torque of the ETM 220 is significantly smaller than the local maximum drag torque of the ICE 210. In such cases, it is possible to rotate the crankshaft 22 counterclockwise and clockwise repeatedly. The energy of the ETM 220 may thus be harvested in the gas pressure of the ICE 210 with each repetition. With each repetition, the pressure increases, as the volume changes in the combustion chamber 18. This increases the compression work and, after each compression, the energy stored in the compressed gas additionally accelerates the crankshaft 22. The current speed may of the crankshaft 22 be observed to detect the change of direction point that is sufficient for the procedure. The following paragraphs describe methods for the crankshaft speed detection, allowing to verify that the local maximum drag torque in the counterclockwise rotation is not exceeded and to obtain information about the stored energy in the system.

Figure 8:
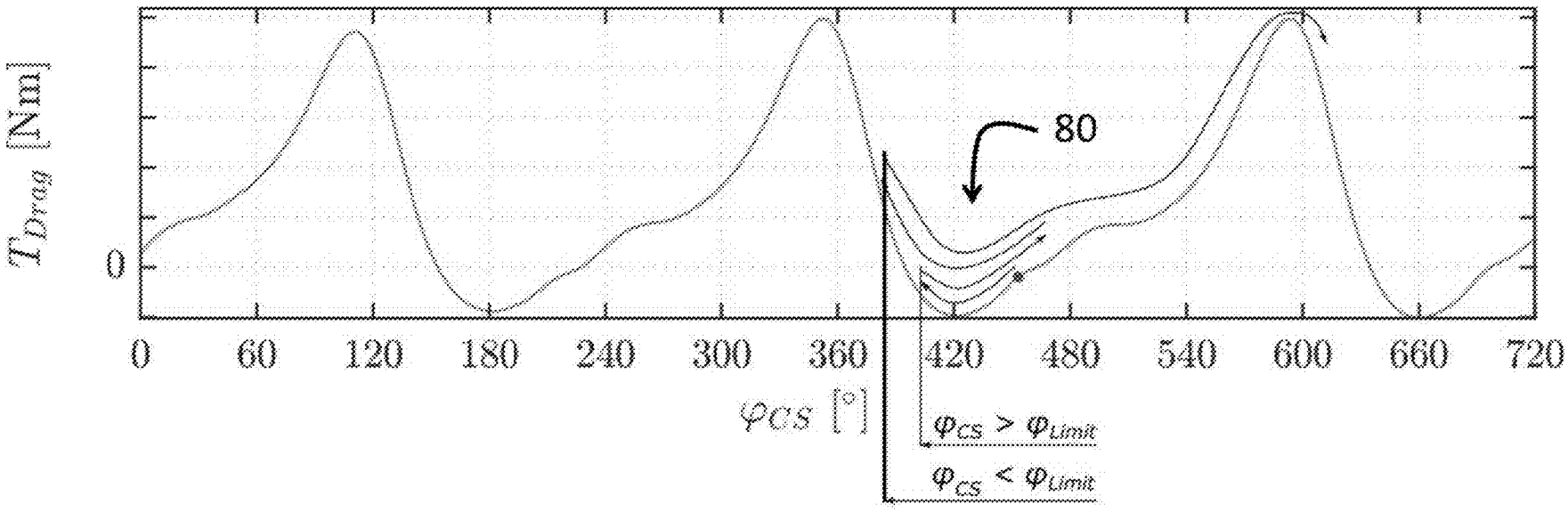
FIG. 8 illustrates variations of the drag torque $T_{Drag}$ curve using the example of the three-cylinder inline internal combustion engine, with alternating rotation of the crankshaft in the counterclockwise and clockwise direction, and with emphasis on the corresponding angle of rotation $\varphi_{CS}$.
Figure 9:
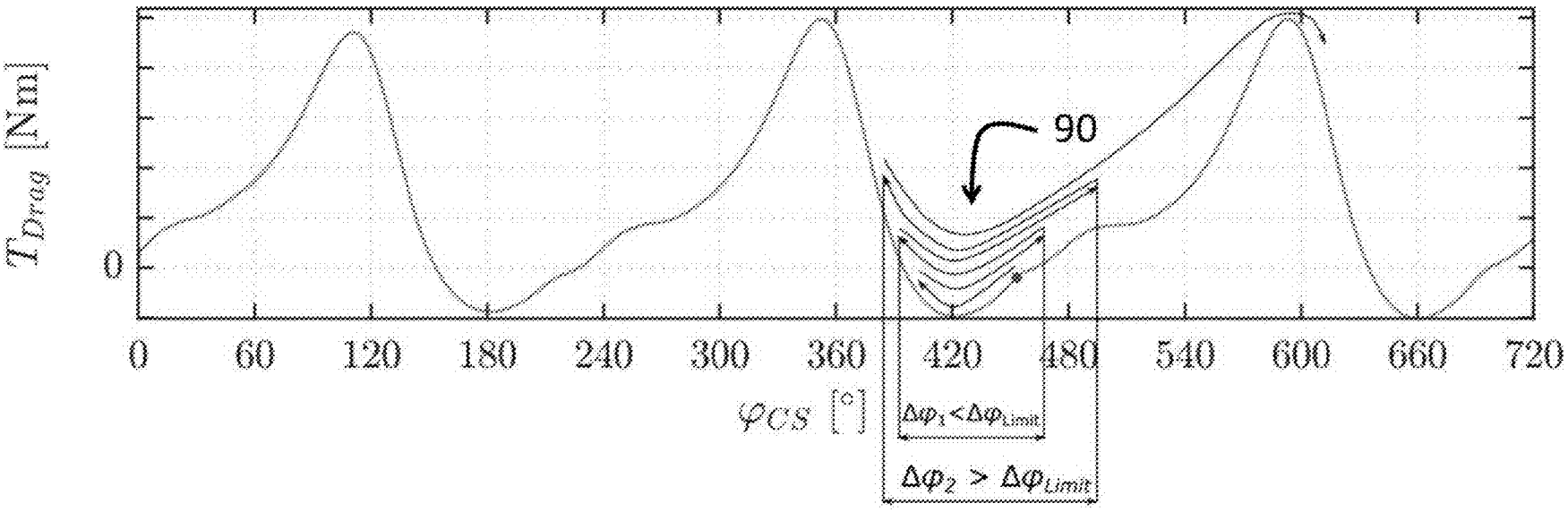
FIG. 9 illustrates variations of the drag torque $T_{Drag}$ curve using the example of the three-cylinder inline internal combustion engine, with alternating rotation of the crankshaft in the counterclockwise and clockwise direction, and with emphasis on the corresponding change of angle of rotation $\Delta\varphi_{CS}$.

With reference to FIG. 8, one possible method comprises an observation of the reached angle in the counterclockwise rotation. The covered angle increases with every repetition. If a defined angle limit $\varphi_{Limit}$ is reached after several repetitions, the energy stored in the compressed gas is sufficient to start the ICE 210. FIG. 8 shows variations of the drag torque $T_{Drag}$ curve using the example of the three-cylinder inline ICE 210. Arrows in an area 80 of the graph indicate alternating rotation of the crankshaft 22 in the counterclockwise and clockwise directions, and the corresponding angles of rotation $\varphi_{CS}$ With reference to FIG. 9, it is also possible to observe the change in angle Δφ between the current angular position of the crankshaft 22 and the position of the change of direction point. In this method, Δφ is directly proportional to the angular movement of the crankshaft 22. FIG. 9 shows variations of the drag torque $T_{Drag}$ curve using the example of the three-cylinder inline ICE 210. Arrows in an area 90 of FIG. 9 arrows indicate alternating rotation of the crankshaft 22 in the counterclockwise and clockwise direction, and the corresponding changes of angle of rotation $\Delta\varphi_{CS}$. The changes in angle increase with every repetition. The energy stored in the compressed gas is sufficient to start the ICE 210 when a predefined limit in the change in angle $\Delta\varphi_{Limit}$ is reached. In combination with the drag torque $T_{Drag}$, the angular movement of the crankshaft 22 is an equivalent for the stored energy. When the energy stored in the compressed gas is sufficient, the ETM 220 may now start the ICE 210.

An alternative method may be based on a predetermined number of repetitions used in combination with a predetermined level of electrical current for various temperature conditions. After the predetermined number of repetitions the energy stored in the c compressed gas is expected to be sufficient to start the ICE 210.

Figure 10:
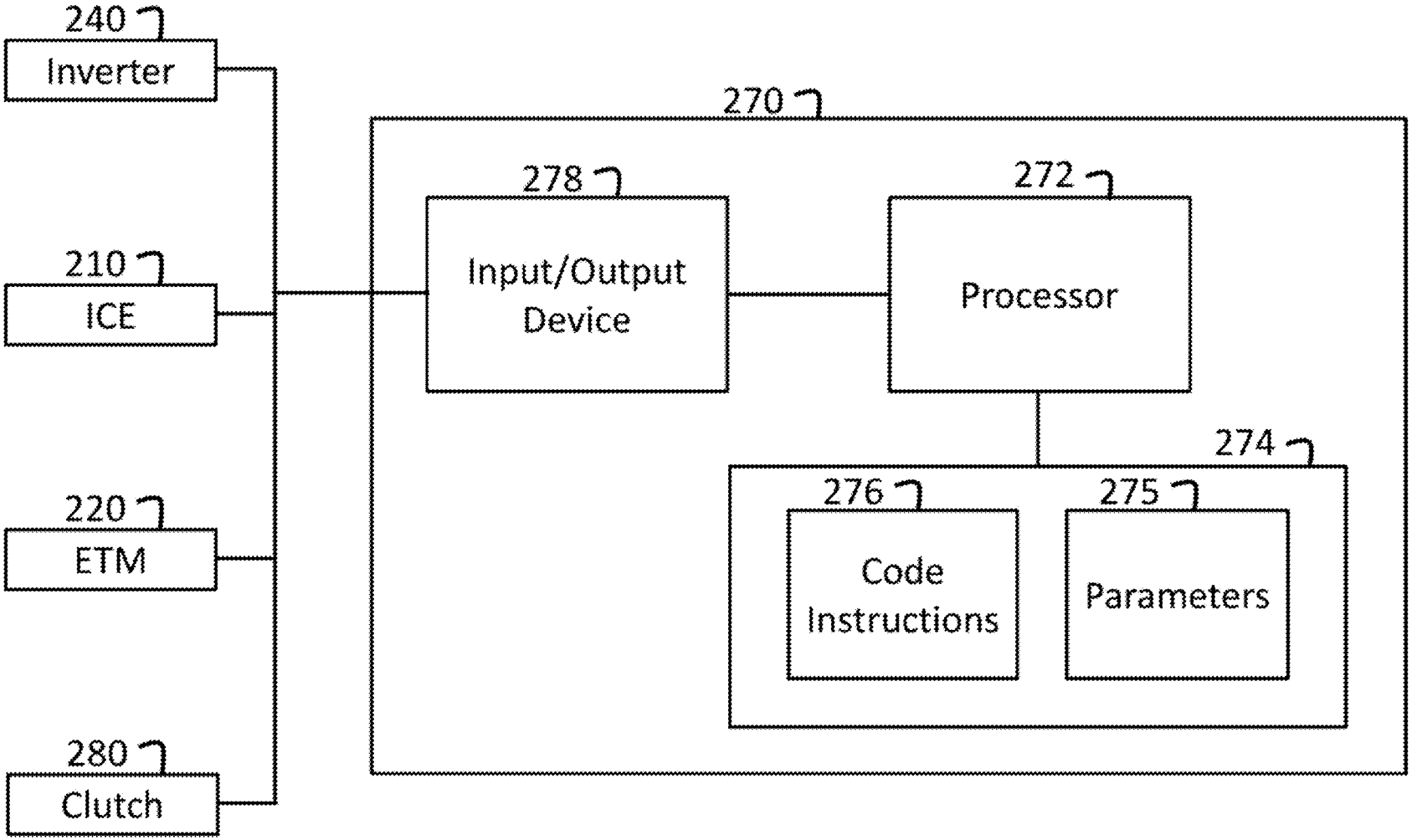
FIG. 10 is a block diagram showing components of an engine control unit in accordance with an embodiment of the present technology.

FIG. 10 is a block diagram showing components of the ECU 270. The ECU 270 comprises a processor or a plurality of cooperating processors (represented as a single processor 272 for simplicity), a memory device or a plurality of memory devices (represented as a single memory device 274 for simplicity), an input/output device or a plurality of input/output devices (represented as an input/output device 278 for simplicity). Separate input and output devices may be present instead of the input/output device 278. The input/output device 278 may be adapted communicate with the ICE 210, the ETM 220, the inverter 240 and the clutch 280 (if present in the powertrain 200), for providing control instructions to these components of the powertrain 200 and for receiving feedback signals from these components of the powertrain 200. The memory device 274 may comprise a database 275 for storing parameters which may include, for example and without limitation, the minimum ignition speed of the ICE 210, the minimum time for the counterclockwise rotation of the crankshaft 22, the minimum compression time for the clockwise rotation of the crankshaft 22, the minimum drag torque $T_{Drag}$ to be reached before the reversal point, the maximum of the drag torque $T_{Drag}$, the maximum duration of the rotation in counterclockwise direction, the maximum compression time for the counterclockwise rotation of the crankshaft 22, the speed limit a for the counterclockwise rotation of the crankshaft 22, the threshold value $\delta$ for the derivative of the drag torque $dT_{Drag}/d\varphi$, the angle limit $\varphi_{Limit}$ for repetitive counterclockwise rotations of the crankshaft 22, the predefined limit in the change in angle $\Delta\varphi_{Limit}$ for repetitive counterclockwise rotations of the crankshaft 22.

The processor 272 is operatively connected to the memory device 274 and to the input/output device 278. The memory device 274 may comprise a non-transitory computer-readable medium 276 for storing code instructions that are executable by the processor 272 to perform the operations allocated to the ECU 270 in the sequence 300. The ECU 270 may also control a plurality of functions of the ICE 210, including for example and without limitation, fuel injection and ignition. The ECU 270 may further be operatively connected to the gearbox 230 and control its operation.

As such, the methods, engine control units and powertrains implemented in accordance with some non-limiting embodiments of the present technology can be represented as follows, presented in numbered clauses.

Clauses

[Clause 1] A method for starting an internal combustion engine, the engine having:

one or more cylinders, at least one cylinder head connected to the one or more cylinders, one or more pistons, each piston being disposed in a corresponding one of each of the one or more cylinders, one or more variable volume combustion chambers, each combustion chamber being defined between a corresponding one of the one more cylinders, the corresponding piston and the at least one cylinder head, and a crankshaft operatively connected to each of the one or more pistons, the method comprising:

a) selectively rotating the crankshaft, using an electric turning machine operatively connected to the crankshaft, in a first direction toward a reversal point close to a local maximum drag torque of the internal combustion engine without rotating the crankshaft beyond the reversal point;

b) following operation a), selectively rotating the crankshaft, using the electric turning machine, in a second direction opposite from the first direction; and c) following operation b), selectively injecting fuel in one of the one or more combustion chambers in which the corresponding piston first reaches a top dead center (TDC) position and selectively igniting the fuel in the one of the one or more combustion chambers.

[Clause 2] The method clause 1, further comprising executing both operations a) and b) at least a second time before executing operation c).

[Clause 3] The method of clause 2, further comprising:

evaluating an angular position of the crankshaft; and continuing to execute both operations a) and b) until the angular position of the crankshaft reaches a predetermined limit in the first direction after operation a).

[Clause 4] The method of clause 2 or 3, further comprising:

evaluating an angular position of the crankshaft; and continuing to execute both operations a) and b) until a difference between the angular positions of the crankshaft obtained after operation a) and the angular position of the crankshaft obtained after operation b) reaches a predetermined limit.

[Clause 5] The method of any one of clauses 1 to 4, wherein the engine further has:

an accessory engine component driven by the crankshaft so that the accessory engine component rotates once for each two rotations of the crankshaft, the method further comprising:

d) sensing a current angular position of the accessory engine component;

e) determining, based on the current angular position of the accessory engine component, whether the internal combustion engine is stopped in a first rest position or in a second rest position;

f) if the internal combustion engine is stopped in the first rest position:

executing operations a), b) and c); and g) if the internal combustion engine is stopped in the second rest position:

g1) rotating the crankshaft, using the electric turning machine, in the second direction, and g2) following operation g1), injecting fuel in one of the one or more combustion chambers in which the corresponding piston first reaches the TDC position and igniting the fuel in the one of the one or more combustion chambers.

[Clause 6] The method of clause 5, wherein the accessory engine component is a camshaft.

[Clause 7] The method of clause 5 or 6, further comprising determining an angular position of the crankshaft at the reversal point based on the current position of the accessory engine component.

[Clause 8] The method of any one of clauses 1 to 7, further comprising setting a level of current delivered to the electric turning machine according to a desired speed of the crankshaft rotating in the first direction.

[Clause 9] The method of any one of clauses 1 to 8, further comprising determining the reversal point of the internal combustion engine based on a rotational speed of the crankshaft when the crankshaft is rotating in the first direction]

[Clause 10] The method of any one of clauses 1 to 9, further comprising:

sensing a temperature selected from an ambient temperature, an engine coolant temperature, an engine oil temperature, and an air temperature in an intake of the internal combustion engine; and determining a desired speed of rotation of the crankshaft in the first direction as a function of the sensed temperature.

[Clause 11] The method of any one of clauses 1 to 9, further comprising:

sensing a temperature selected from an ambient temperature, an engine coolant temperature, an engine oil temperature, and an air temperature in an intake of the internal combustion engine; and determining a level of current delivered to the electric turning machine when rotating the crankshaft in the first direction as a function of the sensed temperature.

[Clause 12] The method of any one of clauses 1 to 11, wherein rotating the crankshaft toward the reversal point comprises stopping the rotation of the crankshaft at a predetermined angle of rotation corresponding to the reversal point.

[Clause 13] The method of clause 12, further comprising stopping the rotation of the crankshaft in the first direction if the crankshaft does not reach the predetermined angle of rotation ahead of the reversal point within a predetermined time.

[Clause 14] The method of any one of clauses 1 to 13, further comprising:

starting a timer when initiating the rotation of the crankshaft in the first direction; and after a predetermined minimum compression time has elapsed, stopping the rotation of the crankshaft if a rotational speed of the crankshaft in the first direction does not reduce to a predetermined level a before a predetermined maximum compression time.

[Clause 15] The method of any one of clauses 1 to 14, wherein the second direction is a normal operation direction of the internal combustion engine.

[Clause 16] The method of any one of clauses 1 to 15, further comprising:

sensing an angular rotor position of the electric turning machine by injecting a high-frequency signal into the electric turning machine and analyzing a response signal from the electric turning machine; and using the sensed angular rotor position of the electric turning machine to determine an angular position of the crankshaft.

[Clause 17] The method of any one of clauses 1 to 16, further comprising interrupting one or more of the operations a), b) and c) having not yet been performed in response to detecting one or more conditions selected from a detection that the crankshaft is not rotating, a detection of a failure of the internal combustion engine, a detection of a failure of the electric turning machine, and a detection of a command for aborting the starting of the internal combustion engine.

[Clause 18] The method of any one of clauses 1 to 17, further comprising:

calculating a derivative of the drag torque of the internal combustion engine as a function of an angular position of the crankshaft rotating in the first direction; and starting to rotate the crankshaft in the second direction when the derivative of the drag torque reaches a threshold value δ, wherein δ is less than zero.

[Clause 19] An engine control unit, comprising:

an input/output device adapted for communicating with an internal combustion engine, with an electric turning machine operatively connected to the internal combustion engine, and with an inverter adapted for delivering power to the electric turning machine;

a processor operatively connected to the input/output device; and a non-transitory computer-readable medium storing code instructions that are executable by the processor to perform the method according to any one of clauses 1 to 18.

[Clause 20] An engine control unit, comprising:

an input/output device adapted for communicating with an internal combustion engine, with an electric turning machine operatively connected to the internal combustion engine, and with an inverter adapted for delivering power to the electric turning machine; and a processor operatively connected to the input/output device, the processor being configured for:

a) selectively causing the inverter to deliver power to the electric turning machine for causing a rotation of a crankshaft of the internal combustion engine in a first direction toward a reversal point close to a local maximum drag torque of the internal combustion engine without rotating the crankshaft beyond the reversal point;

b) following operation a), selectively causing the inverter to deliver power to the electric turning machine for causing a rotation of the crankshaft in a second direction opposite from the first direction; and c) following operation b), selectively causing an injection system of the internal combustion engine to inject fuel in a combustion chamber of the internal combustion engine in which a corresponding piston first reaches a top dead center (TDC) position and selectively causing an ignition system of the internal combustion engine to ignite the fuel injected in the combustion chamber.

[Clause 21] The engine control unit of clause 20, further comprising a memory device operatively connected to the processor.

[Clause 22] A powertrain, comprising:

an internal combustion engine, the engine having:

one or more cylinders, at least one cylinder head connected to the one or more cylinders, one or more pistons, each piston being disposed in a corresponding one of each of the one or more cylinders, one or more variable volume combustion chambers, each combustion chamber being defined between a corresponding one of the one more cylinders, the corresponding piston and the at least one cylinder head, and a crankshaft operatively connected to each of the one or more pistons;

a battery;

an inverter adapted for converting power delivered by the battery;

an electric turning machine operatively connected to the crankshaft and adapted for rotating the crankshaft when receiving power from the inverter; and the engine control unit as defined in any one of clauses 19 to 21.

Modifications and improvements to the above-described embodiments of the present technology may become apparent to those skilled in the art. The foregoing description is intended to be exemplary rather than limiting. The scope of the present technology is therefore intended to be limited solely by the scope of the appended claims.

What is claimed is:

1. A method for starting an internal combustion engine, the engine having:

one or more cylinders, each of the one or more cylinders having at least one intake valve and at least one exhaust valve, at least one cylinder head connected to the one or more cylinders, one or more pistons, each piston being disposed in a corresponding one of each of the one or more cylinders, one or more variable volume combustion chambers, each combustion chamber being defined between a corresponding one of the one more cylinders, the corresponding piston and the at least one cylinder head, and a crankshaft operatively connected to each of the one or more pistons, the method comprising:

a) selectively rotating the crankshaft, using an electric turning machine operatively connected to the crankshaft, in a first direction toward a reversal point close to a local maximum of a drag torque of the internal combustion engine without rotating the crankshaft beyond the reversal point, the drag torque of the internal combustion engine varying according to opening and closing of the intake and exhaust valves, a predetermined level of current delivered to the electric turning machine being based at least in part on the drag torque of the internal combustion engine;

b) following operation a), selectively rotating the crankshaft, using the electric turning machine, in a second direction opposite from the first direction; and c) following operation b), selectively injecting fuel in one of the one or more combustion chambers in which the corresponding piston first reaches a top dead center (TDC) position and selectively igniting the fuel in the one of the one or more combustion chambers.

2. The method of claim 1, further comprising executing both operations a) and b) at least a second time before executing operation c).

3. The method of claim 2, further comprising:

evaluating an angular position of the crankshaft; and continuing to execute both operations a) and b) until the angular position of the crankshaft reaches a predetermined limit in the first direction after operation a).

4. The method of claim 2, further comprising:

evaluating an angular position of the crankshaft; and continuing to execute both operations a) and b) until a difference between the angular positions of the crankshaft obtained after operation a) and the angular position of the crankshaft obtained after operation b) reaches a predetermined limit.

5. The method of claim 1, wherein the engine further has:

an accessory engine component driven by the crankshaft so that the accessory engine component rotates once for each two rotations of the crankshaft, the method further comprising:

d) sensing a current angular position of the accessory engine component;

e) determining, based on the current angular position of the accessory engine component, whether the internal combustion engine is stopped in a first rest position or in a second rest position;

f) if the internal combustion engine is stopped in the first rest position:

executing operations a), b) and c); and g) if the internal combustion engine is stopped in the second rest position:

g1) rotating the crankshaft, using the electric turning machine, in the second direction, and g2) following operation g1), injecting fuel in one of the one or more combustion chambers in which the corresponding piston first reaches the TDC position and igniting the fuel in the one of the one or more combustion chambers.

6. The method of claim 5, wherein the accessory engine component is a camshaft.

7. The method of claim 5, further comprising determining an angular position of the crankshaft at the reversal point based on the current position of the accessory engine component.

8. The method of claim 1, wherein the level of current delivered to the electric turning machine is further based at least in part on a desired speed of the crankshaft rotating in the first direction.

9. The method of claim 1, further comprising determining the reversal point of the internal combustion engine based on a rotational speed of the crankshaft when the crankshaft is rotating in the first direction.

10. The method of claim 1, further comprising:

sensing a temperature selected from an ambient temperature, an engine coolant temperature, an engine oil temperature, and an air temperature in an intake of the internal combustion engine; and determining a desired speed of rotation of the crankshaft in the first direction as a function of the sensed temperature.

11. The method of claim 1, further comprising:

sensing a temperature selected from an ambient temperature, an engine coolant temperature, an engine oil temperature, and an air temperature in an intake of the internal combustion engine;

wherein the level of current delivered to the electric turning machine when rotating the crankshaft in the first direction is further based at least in part on the sensed temperature.

12. The method of claim 1, wherein rotating the crankshaft toward the reversal point comprises stopping the rotation of the crankshaft at a predetermined angle of rotation corresponding to the reversal point.

13. The method of claim 12, further comprising stopping the rotation of the crankshaft in the first direction if the crankshaft does not reach the predetermined angle of rotation ahead of the reversal point within a predetermined time.

14. The method of claim 1, further comprising:

starting a timer when initiating the rotation of the crankshaft in the first direction; and after a predetermined minimum compression time has elapsed, stopping the rotation of the crankshaft if a rotational speed of the crankshaft in the first direction does not reduce to a predetermined level a before a predetermined maximum compression time.

15. The method of claim 1, wherein the second direction is a normal operation direction of the internal combustion engine.

16. The method of claim 1, further comprising:

sensing an angular rotor position of the electric turning machine by injecting a high-frequency signal into the electric turning machine and analyzing a response signal from the electric turning machine; and using the sensed angular rotor position of the electric turning machine to determine an angular position of the crankshaft.

17. The method of claim 1, further comprising interrupting one or more of the operations a), b) and c) having not yet been performed in response to detecting one or more conditions selected from a detection that the crankshaft is not rotating, a detection of a failure of the internal combustion engine, a detection of a failure of the electric turning machine, and a detection of a command for aborting the starting of the internal combustion engine.

18. The method of claim 1, further comprising:

calculating a derivative of the drag torque of the internal combustion engine as a function of an angular position of the crankshaft rotating in the first direction; and starting to rotate the crankshaft in the second direction when the derivative of the drag torque reaches a threshold value $\delta$, wherein $\delta$ is less than zero.

19. The method of claim 1, wherein:

the engine further has an accessory engine component driven by the crankshaft so that the accessory engine component rotates once for each two rotations of the crankshaft; and the method further comprises determining an angular position of the crankshaft at the reversal point based on the current position of the accessory engine component.

20. The method of claim 1, wherein operation a) is performed without ignition in the internal combustion engine.

21. An engine control unit, comprising:

an input/output device adapted for communicating with an internal combustion engine, with an electric turning machine operatively connected to the internal combustion engine, and with an inverter adapted for delivering power to the electric turning machine; and a processor operatively connected to the input/output device, the processor being configured for:

a) selectively causing the inverter to deliver power to the electric turning machine for causing a rotation of a crankshaft of the internal combustion engine in a first direction toward a reversal point close to a local maximum of a drag torque of the internal combustion engine without rotating the crankshaft beyond the reversal point, the drag torque of the internal combustion engine varying according to opening and closing of intake and exhaust valves of the internal combustion engine, a predetermined level of current delivered to the electric turning machine being based at least in part on the drag torque of the internal combustion engine;

b) following operation a), selectively causing the inverter to deliver power to the electric turning machine for causing a rotation of the crankshaft in a second direction opposite from the first direction; and c) following operation b), selectively causing an injection system of the internal combustion engine to inject fuel in a combustion chamber of the internal combustion engine in which a corresponding piston first reaches a top dead center (TDC) position and selectively causing an ignition system of the internal combustion engine to ignite the fuel injected in the combustion chamber.

22. A powertrain, comprising:

the engine control unit as defined in claim 21;

the internal combustion engine, the engine having:

one or more cylinders, each of the one or more cylinders having at least one intake valve and at least one exhaust valve, at least one cylinder head connected to the one or more cylinders, one or more pistons, each piston being disposed in a corresponding one of each of the one or more cylinders, one or more combustion chambers, each combustion chamber being defined between a corresponding one of the one more cylinders, the corresponding piston and the at least one cylinder head, and the crankshaft being operatively connected to each of the one or more pistons;

a battery; and the electric turning machine;

the inverter being adapted for converting power delivered by the battery for rotating the crankshaft.

* * * * *